US005351950A

United States Patent [19]

Frankum

[11] Patent Number: 5,351,950

[45] Date of Patent: Oct. 4, 1994

[54] GOLF CUP AND METHOD OF MAKING SAME

[76] Inventor: John Frankum, 1641 Edleshearan Rd., Lake Mary, Fla. 32746

[21] Appl. No.: 126,245

[22] Filed: Sep. 23, 1993

[51] Int. Cl.[5] ..... A63B 57/00

[52] U.S. Cl. ..... 273/34 R; 273/184 A

[58] Field of Search ..... 273/34 R, 34 A, 34 B, 273/184 A

[56] References Cited

U.S. PATENT DOCUMENTS

| | | | |
|---|---|---|---|
| 672,395 | 4/1901 | Felton | 273/34 R |
| 4,120,496 | 10/1978 | Niina | 273/34 R |
| 4,270,751 | 6/1981 | Lawy | 273/34 R |
| 4,928,417 | 5/1990 | Boudreau | 273/34 R X |

*Primary Examiner*—George J. Marlo
*Attorney, Agent, or Firm*—Allen, Dyer, Doppelt, Franjola & Milbrath

[57] ABSTRACT

A substantially non-metallic golf cup provides a metallic sound indicating that a golf ball has dropped into the cup. A non-metallic carriage having a metallic portion is suspended above a metallic plate. A golf ball dropping into the cup forces the carriage to be displaced causing the carriage metallic portion to make contact with the metallic plate thus producing the metallic sound. A transparent cover on the carriage is hermetically sealed for protecting advertising material contained within the cover for viewing when approaching the golf cup.

24 Claims, 4 Drawing Sheets

GOLF CUP AND METHOD OF MAKING SAME

BACKGROUND OF THE INVENTION

1. Field of Invention

The present invention generally relates to a golf cup and more particularly to a golf cup and method for providing an audible sound as a golf ball is dropped into the cup and an advertising method effective when approaching the cup.

2. Background Art

Golf cups are well known and have had various constructions while maintaining a basic form in order to meet standard rules within golfing associations. With the ever increasing interest in golf around the world, golf cups are seen as one effective marketing tool for adding to the golfing interests of the public.

U.S. Pat. No. 4,928,417 issued to Louis H. Boudreau on May 29, 1990 discloses a golf cup advertising device having a substantially doughnut shaped insert which fits into a conventional golf cup to display an advertisement. The advertisement is visible to a golfer when putting or when retrieving the golf ball from the cup. The cup must be removed from its place in the ground when replacing advertising devices.

Metal golf cups have typically been replaced by cups constructed of molded plastic in order to better withstand the exposure to weather and provide a device having lower maintenance and replacement cost. When attempting to understand the psyche of a golfer however, it is understood that metal cups provide a benefit that not found in their plastic replacements, the pinging sound when a putt results in a golf ball dropping into the cup. To this end, golf cups have been constructed using metal parts and configured such that a ball dropping into the cup creates this pinging sound. In one known device, a plastic golf cup comprises a cast metal inner cup having a center hole for receiving the golf flag stick. A metal disk covers the metal cup for providing a hollow metal can. The disk has a center hole coaxial with the cup for loosely receiving the flag stick. The effect of the metal can is such that a pinging sound is created when a golf ball is dropped into the cup bringing added pleasure to the golfer.

SUMMARY OF INVENTION

A golf cup comprising a vertical tube having top and bottom ends is provided with a carriage having a non-metallic cover placed on a portion of the carriage facing the tube top end. Means for providing a metal pinging sound is included for indicating that a golf ball has dropped into the tube. The golf cup comprises means for movably suspending the carriage away from the sounding means such that the suspending means is responsive to a force from a golf ball dropped from the tube top end onto the carriage thus causing the carriage to be displaced for making contact with the sounding means and producing the metal pinging sound.

In a preferred embodiment of the invention, the golf cup comprises a cylindrical tube having a base. The base has a center hole coaxial with the axis of the tube for holding a flag stick. The base peripheral portion is dimensioned to be affixed within the tube bottom end. A metal plate having a center aperture coaxial with the tube axis is dimensioned to loosely receive the flag stick. The plate has a peripheral portion dimensioned to loosely fit within the tube. A rod having a proximal end affixed to the base and a distal end affixed to the plate is formed to hold the plate between the tube inside wall and the base while maintaining the plate in coaxial alignment with the tube axis. A carriage having a central opening coaxial with the tube axis is dimensioned to allow the flag stick to pass freely through while preventing a golf ball from passing therethrough. The carriage has a metal portion positioned for contacting the plate. A transparent cover is removably affixed to the carriage. The cover is positioned for viewing from the tube top end. A support member having a first end positioned for supporting the carriage and a second end affixed to the base is provided such that a spring affixed between the support first end and the carriage biases the carriage away from the plate. The biasing is sufficient for a golf ball dropped into the tube top end to cause the carriage metal portion to make contact with the plate and thus making a distinctive metal sound.

In an alternate embodiment of the invention, the carriage is formed from clear plastic material. The carriage has a metal portion proximate the plate for contacting the plate when the force from the dropped ball causes the carriage to be displaced toward the plate. In the preferred embodiment, the rod is formed into a sinusoidal shape.

In the preferred embodiment, the carriage further comprises a generally concave circular disk shape which is concave upward toward the tube top end. The carriage peripheral portion dimensioned to loosely fit into the tube and the carriage central opening forms a circular inner edge such that the inner edge and peripheral portion form concentric circles. A flange member extends downward from the inner edge. The flange member includes an edge forming a shelf. The cover has a generally concave circular disk shape, concave upward toward the tube top end. The cover peripheral portion is dimensioned to coaxially fit into the tube. A peripheral flange member extends downward from the cover peripheral portion and is dimensioned to fit around the carriage peripheral portion. The cover flange member forms a gap at the tube wall. The cover has a central opening forming a circular inner edge. The inner edge and peripheral portion substantially forming concentric circles. A cover central flange member extending downward from the inner edge is dimensioned to fit within the carriage central flange member. A central O-ring is located between the cover and carriage central flanges and a peripheral O-ring is located between the carriage peripheral portion and the cover peripheral flange member. The O-rings are dimensioned for maintaining a sufficiently dry environment for the advertising element placed between the cover and carriage. In the preferred embodiment, grooves are placed in the carriage inner and peripheral portions for positioning the O-rings.

A method is also provided in the preferred embodiment for displaying removable advertising in combination with delivering a metal pinging sound when a golf ball drops into the cup. The method comprises the steps of providing a vertical tube having top and bottom ends, the tube bottom end having a base affixed within the periphery of the tube, affixing a metal plate to the base, supporting a non-metallic carriage proximate the plate between the base and tube top end, sufficiently biasing the carriage away from the plate for supporting holding the carriage out of contact with the plate, the biasing defeated by a force from a golf ball dropped onto the carriage from the tube top end, affixing a metal extension member to the carriage, contacting the plate with the metal extension member for causing a metal pinging sound, placing a transparent cover onto the carriage, the cover positioned to be viewed for the tube top end, placing an advertising element between the cover and the carriage for viewing the element from the tube top end, and removably sealing the cover to the carriage.

It is an object of the invention to provide a golf cup that provides a metallic pinging sound when a golf ball is dropped into the cup onto a non-metallic portion of the cup. It is a further object to provide interchangeable advertisement indicia within the cup such that a golfer can view such indicia when approaching the cup to remove the flag stick and when reaching down to remove his golf ball after successfully completing a putt. It is also an object of the invention to present an advertisement during a feeling of accomplishment as is the case when a successful putt has been made and especially when the putt has been applauded by a pinging sound adding to the feeling.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
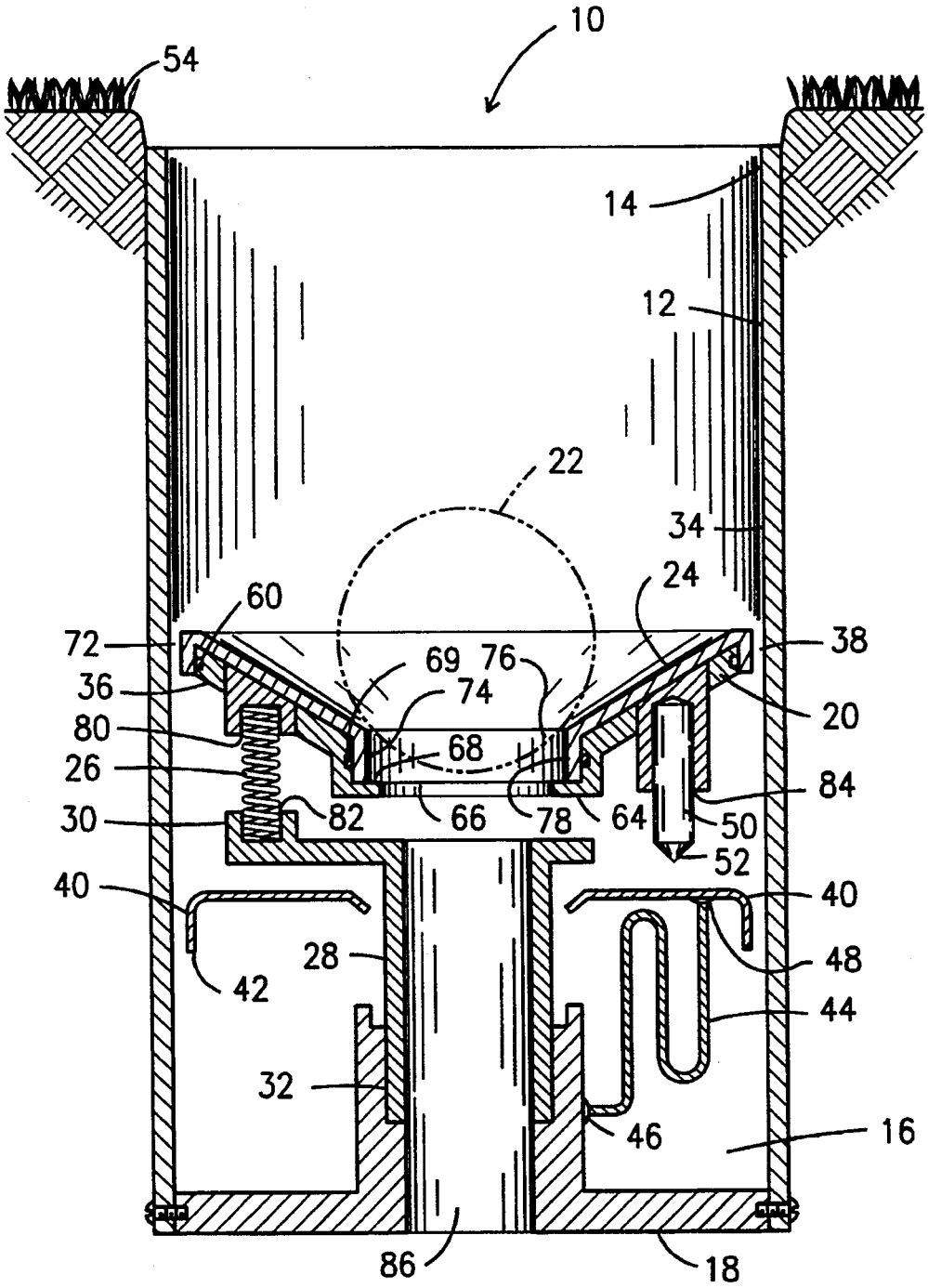
FIG. 1 is a partial cross-sectional view of the preferred embodiment of the invention illustrating the carriage suspended above the metallic plate wherein a spring biases the carriage away from the plate.

The preferred embodiment of the present invention will now be described with reference to FIGS. 1 through 6, where the Golf cup is referred to generally by the reference numeral 10.

With reference to FIG. 1, the golf cup 10 of the preferred embodiment comprises a vertical tube 12 having a top end 14 and a bottom end 16. A base 18 is dimensioned to fit within the tube 12 and is affixed to the tube bottom end 16. A carriage 20 is dimensioned to fit with in the tube 12 and positioned for receiving golf balls 22 entering the tube top end 14. A cover 24 is placed over the carriage 20 on a side of the carriage 20 facing the tube top end 14. The carriage 20 is located generally between the top 14 and bottom 16 end of the tube 12 as is typical in golf cups. Further details of the carriage 20 will be described later in this section. The carriage 20 is affixed to a spring 26 which in turn is affixed to a support member 28 at a support member first end 30. A support member second end 32 is affixed to the base 18. In an alternate embodiment the carriage 20 is affixed to a flexible element (not shown) wherein the flexible element is affixed between the carriage and the tube inside wall 34 at a position proximate the middle of the tube 12. The carriage 20 peripheral edge 36 forms a gap 38 with the tube inside wall 34 wherein the gap 38 is sufficiently small to prevent the golf ball 22 from passing therethrough. A metal plate 40 in the form of a circular disk is dimensioned to fit within the tube 12 such that the plate peripheral portion 42 is spaced from the tube inside wall 34. An elongated rod 44 has a proximal end 46 affixed to the base 18 and a distal end 48 affixed to the plate 40 for suspending the plate 40 out of contact with any portion of the golf cup 10 except where it is affixed to the rod 44. In the preferred embodiment, the elongated rod 44 takes on a sinusoidal shape which further reduces damping to the plate 40 and enhances the ringing sound provided when the plate 40 is struck. With such an arrangement, the plate 40 is reasonably free to vibrate undamped when struck by a metal element 50 extending from the carriage 20. In the arrangement described, the metal element 50 has one end 52 proximate the metal plate 40. The spring 26 biases the carriage 20 away from the plate 40 with a biasing force that is overcome by the golf ball 22 dropping from the top end 14 onto the carriage Again with reference to FIG. 1, in preferred operation, the golf cup 10 is placed into the ground 54 to permit a golf ball 22 rolling over the ground 54 toward the cup 10 is permitted to drop into the cup 10 and strike the carriage In doing so, the carriage 20 is displaced toward the metal plate 40 causing the metal element 50 to strike the plate 40 and create a metal pinging sound accomplishing an objective of the invention.

Figure 2:
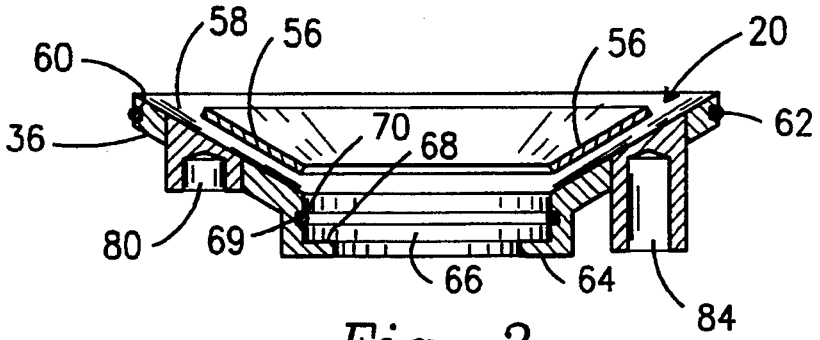
FIG. 2 is a partial cross-sectional view of the carriage illustrated in FIG. 1.

The cover 24 in the preferred embodiment is transparent plastic permitting advertising material 56 as illustrated in FIG. 2 to be placed on a carriage surface 58 facing the tube tip end 14. The carriage 20 is constructed of molded plastic. With further reference to FIG. 2, an outside groove 60 is formed along the carriage edge 36 peripheral portion for receiving a peripheral O-ring 62. The carriage 20 comprises a central flange member 64 extending downward from a carriage center opening 66. The flange member 64 has an L-shaped cross-section wherein a lip 68 protrudes into the opening 66. The portion of the flange 64 extending downward form the opening 66 comprises a groove 69 for receiving an inner O-ring 70. Again with reference to FIG. 1, the transparent cover 24 is shown to further comprise a peripheral flange member 72 extending downward from the peripheral edge of the cover 24 and dimensioned to fit over the carriage edge 36. In the preferred embodiment, the peripheral O-ring 62 is sized to provide an hermetic seal sufficient to prevent moisture from penetrating past the peripheral edge 36 and onto the advertising element 56. The cover 24 further comprises a circular inner edge 74 forming an opening 76. A cover central flange member 78 extends downward from the cover inner edge 74 and is dimensioned to fit within the carriage central flange member 64. The inner O-ring 70 is sized to provide an hermetic seal such that in combination with the peripheral O-ring 62 is sufficient to keep the advertising element 56 dry. The gap 38 is sufficient to permit the carriage 20 to move unrestricted by the tube inside wall 34.

Figure 3:
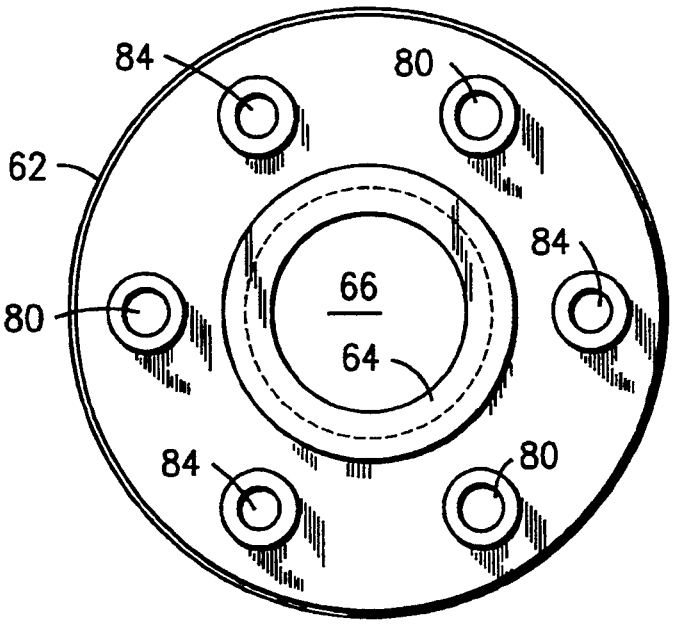
FIG. 3 is a top view of the carriage illustrated in FIG. 1.
Figure 4:
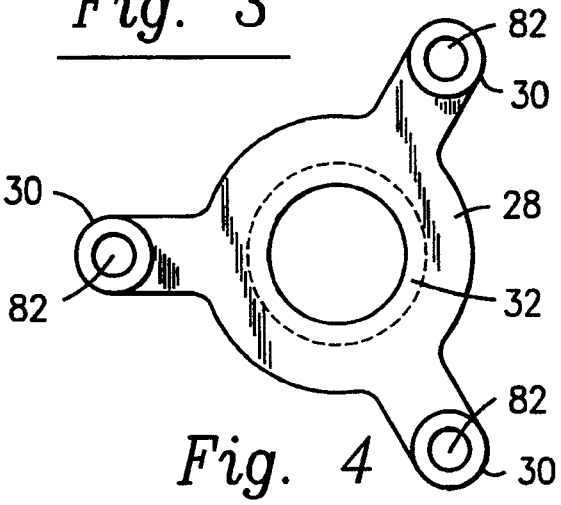
FIG. 4 is a partial top view of the support member of the preferred embodiment of FIG. 1.

In the preferred embodiment and as illustrated in FIGS. 1 and 2, the carriage 20 is formed into a bowl shape concave upward toward the tube top 14. Further, the carriage 20 in the preferred embodiment comprises well portions 80 for receiving on end of the springs 26. Corresponding well portions 82 are formed in the support member 28 for receiving a second spring end. Three such portions 80 and 82 are used in the preferred embodiment as illustrated in FIGS. 3 and 4. The metal element 50 is fitted into a bore 84 formed in a lower portion of the non-metallic carriage 20 for extending towards the metal plate 40. Three symmetrically positioned metal elements 50 are used in the preferred embodiment. Each element 50 is fitted into a respective bore 84 illustrated in FIG. 3. The metal plate 40 is formed with a flanged peripheral edge for further enhancing the pinging sound desired much the way a chime or bell is rounded for achieving enhanced ringing qualities. In an alternate embodiment, metal chimes (not shown) are suspended from the carriage 20 from the bore 84 positions. The chimes pass through apertures in the metal plate. The displacement of the carriage 20 causes the chimes to make contact with the metal plate 40 resulting in an alternative metal sound.

As illustrated in FIG. 1, the base 18 has a coaxial hole 86 dimensioned to hold a flag stick (not shown) typically placed in a golf cup 10. The support structure 28 is affixed to the base 18 while permitting the flag stick to freely pass the structure 28. The carriage opening 66 and accordingly, the cover opening 76 are large enough to loosely receive the flag stick but small enough to cradle a golf ball 22.

As can be understood from the above description, the cover 24 is removable affixed to the carriage 20 for holding advertising elements 56 such as advertising indicia on a paper sheet formed to fit within and seen through the transparent cover 24. To provide ease in replacing the advertising elements 56, a cover removal tool 88 is provided for the preferred embodiment of the invention and is illustrated in FIGS. 5 and 6.

Figure 5:
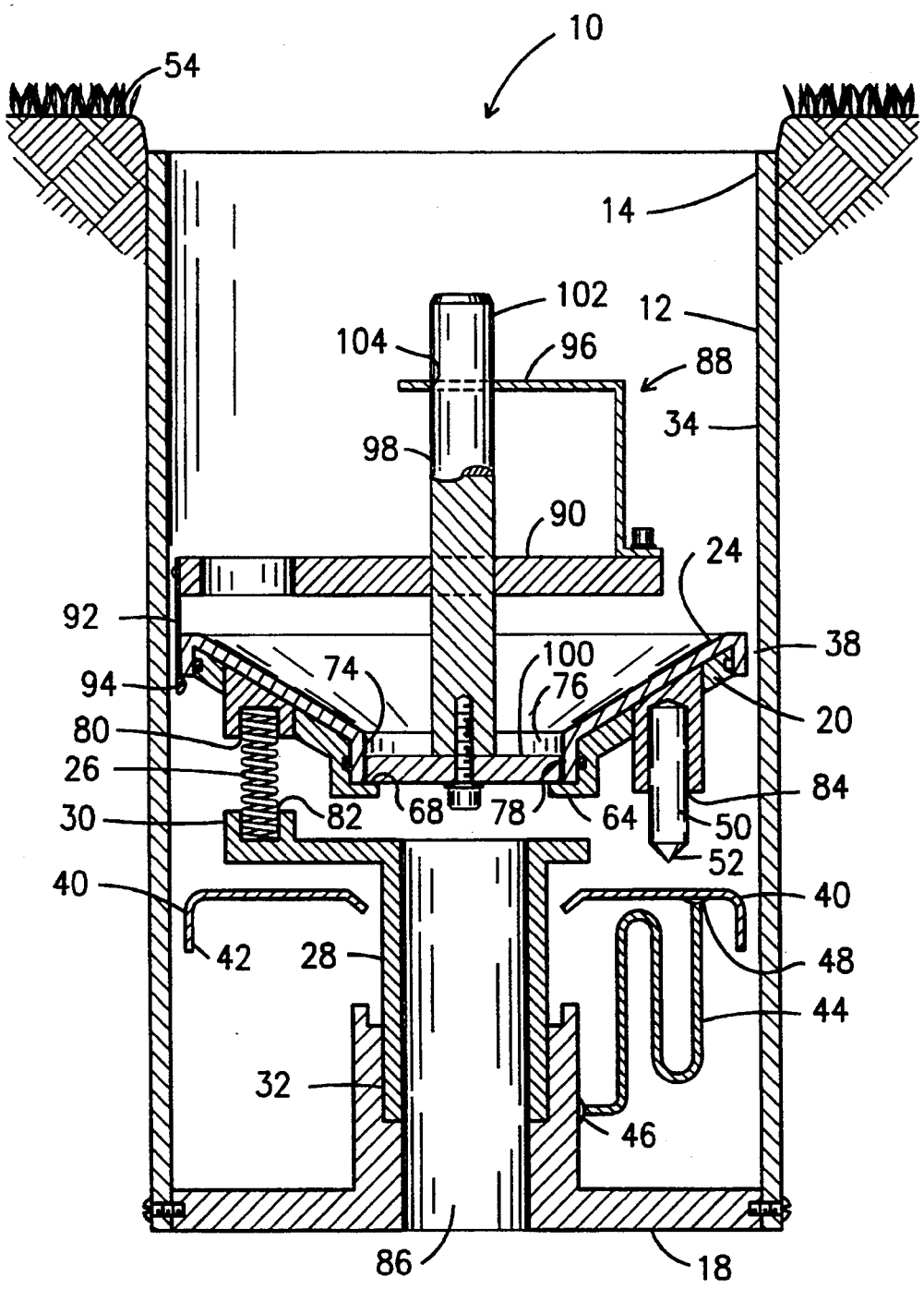
FIG. 5 is a partial cross-sectional view of the preferred embodiment of FIG. 1 further illustrating carriage cover removal tool.
Figure 6:
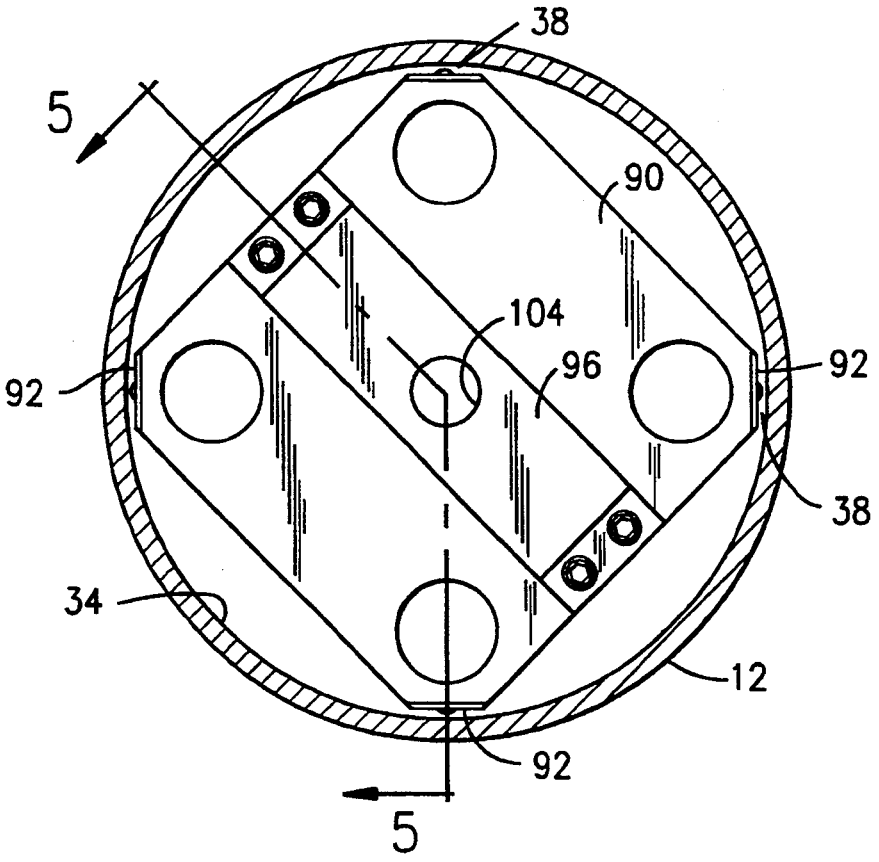
FIG. 6 is a partial top view of the preferred embodiment of FIG. 5 illustrating the tool.

With reference to FIG. 5, the removal tool 88 comprises a frame 90 dimensioned to fit within the tube 12. Flexible attachment members 92 are affixed to the periphery of the frame 90 for sliding over the cover peripheral flange member 72. A hook-like element 94 at the end of the flexible attachment member 92 cradles the cover flange member 72. A handle 96 is affixed to the frame 90 for ease in positioning the frame 90 and attaching the attachment members 92 to the cover flange member 72. The gap 38 is sized to receive the attachment members 92. The removal tool 88 further comprises a push rod 98 having a circular push rod plate 100 and a shaft 102 affixed perpendicular to and coaxial with the circular plate 100. The plate 100 is dimensioned to loosely fit within the cover flange member 72 and large enough to rest upon the carriage inner flange lip 68. The shaft 102 is guided into coaxial arrangement with the carriage 21 by passing through a coaxial opening 104 in the handle 96 further illustrated in FIG. 6. FIG. 6 further identifies the cross-sectional view illustrated in FIG. 5.

By biasing the push rod plate 100 against the carriage flange lip 68 and pulling or providing an opposite bias by pulling against the cover flange 72, the cover 24 is removed from its position on the carriage 20 thus accessing the advertising element 56 for replacement. Such access to the advertising element 56 without having to remove the cup from its position within the ground 54 provide an efficient and cost effective method for servicing the cup While a specific embodiment of the invention has been described in detail herein above for accomplishing the objects of the invention, it is to be understood that various modifications may be made from the specific details described herein without departing from the spirit and scope of the invention as set forth in the appended claims.

Having now described the invention, the construction, the operation and use of preferred embodiments thereof, and the advantageous useful results obtained thereby, the constructions, and reasonable mechanical equivalents thereof obvious to those skilled in the art, are set forth in the appended claims.

What is claimed is:

1. A golf cup comprising:
a vertical tube having top and bottom ends;
a carriage having a non-metallic cover placed on a portion of the carriage facing the tube top end;
pounding means for providing a metal pinging sound indicating that a golf ball has dropped into the tube;
means for movably suspending the carriage away from the sounding means, the suspending means responsive to a force from a golf ball dropped from the tube top end onto the carriage causing the carriage to be displaced for making contact with the sounding means for producing the metal pinging sound.

2. The golf cup as recited in claim 1, further comprising a base supporting the sounding means, the base having a peripheral portion dimensioned to be affixed within the tube bottom end.

3. The golf cup as recited in claim 2, wherein the sounding means comprises;
a metal plate dimensioned to fit within the tube; and
a rod having a proximal end affixed to the base and a distal end affixed to the plate, the rod formed to suspend the plate above the base within the tube, the rod having a length sufficient to sustain the plate in vibration for producing a metal pinging sound when the plate is struck by the carriage.

4. The golf cup as recited in claim 2, wherein the movably suspending means comprises:
a support member having a first end and a second end, the second end affixed to the base;
a spring means affixed between the support first end and the carriage; and
a carriage metal portion positioned for contacting the sounding means when the force from the dropped ball causes the carriage to contact the sounding means.

5. The golf cup as recited in claim 4, further comprising:
the base having a hole coaxial with the axis of the tube, the hole dimensioned for holding a flag stick;
the plate having a center aperture coaxial with the tube axis, the aperture dimensioned for loosely receiving the flag stick, the plate having a peripheral portion dimensioned for fitting within the tube; and
the carriage having a central opening coaxial with the tube axis, the central opening dimensioned to allow the flag stick to freely pass therethrough, the opening sufficient to prevent the golf ball from passing therethrough.

6. The golf cup as recited in claim 1, wherein the non-metallic cover comprises an advertising element.

7. A golf cup comprising:
a tube having top and bottom ends;
a base having a peripheral portion dimensioned to be affixed within the tube bottom end;
a metal plate having a peripheral portion dimensioned to loosely fit within the tube;

a carriage having a peripheral portion dimensioned to loosely fit within the tube for receiving a golf ball dropped from the tube top end;

means for supporting the carriage away from the plate;

a rod having a proximal end affixed to the base and a distal end affixed to the plate, the rod formed to suspend the plate above the base and away from the tube inside wall, the rod having a length sufficient to sustain the plate in vibration for producing a metal pinging sound when the plate is struck by the carriage; and means for biasing the carriage away from the plate, the biasing sufficient for a golf ball dropped from the tube top end into the carriage to cause the carriage to be displaced for contacting the plate; and a transparent cover removably affixed to the carriage, the cover for viewing from the tube top end.

8. The golf cup as recited in claim 7, wherein the biasing means comprises:

a support member having a first end and a second end, the second end affixed to the base; and a spring affixed between the support first end and the carriage.

9. The golf cup as recited in claim 7, further comprising an advertising element sandwiched between the carriage and the cover, the advertising element having indicia affixed thereto for viewing through the transparent cover from the tube top end.

10. The golf club as recited in claim 7, wherein the plate peripheral portion has an arcuate shape for enhancing the metal pinging sound.

11. The golf club as recited in claim 7, further comprising:

the base having a hole coaxial with the axis of the tube, the hole dimensioned for holding a flag stick;

the plate having a center aperture coaxial with the tube axis, the aperture dimensioned for loosely receiving the flag stick, the plate having a peripheral portion dimensioned for fitting within the tube; and the carriage having a central opening coaxial with the tube axis, the central opening dimensioned to allow the flag stick to freely pass therethrough, the opening sufficient to prevent the golf ball from passing therethrough.

12. The golf cup as recited in claim 7, further comprising means for hermetically sealing the advertising element within the cover.

13. The golf cup as recited in claim 12, wherein the sealing means comprises:

the carriage having a concave circular disk shape, concave upward toward the tube top end, the carriage peripheral portion dimensioned to coaxially fit into the tube;

the carriage central opening forming a circular inner edge, the inner edge and peripheral portion substantially forming concentric circles;

a flange member extending downward from the inner edge, the flange member having an edge forming a shelf extending toward the tube axis;

the cover having a concave circular disk shape, concave upward toward the tube top end, the cover peripheral portion dimensioned to fit into the tube;

a peripheral flange member extending downward from the cover peripheral portion, the cover peripheral flange dimensioned to communicate with the carriage peripheral portion;

the cover having a central opening forming a circular inner edge; and a cover central flange member extending downward from the inner edge, the cover central flange dimensioned to communicate with the carriage central flange member.

14. A golf cup comprising:

a cylindrical tube having top and bottom ends;

a base having a center hole coaxial with the axis of the tube for holding a flag stick, the base having a peripheral portion dimensioned to be affixed within the tube bottom end;

a metal plate having a center aperture coaxial with the tube axis, the aperture dimensioned to loosely receive the flag stick, the plate having a peripheral portion dimensioned to loosely fit within the tube;

a rod having a proximal end affixed to the base and a distal end affixed to the plate, the rod formed to hold the plate between the tube inside wall and the base while maintaining the plate in coaxial alignment with the tube axis;

a carriage having a central opening coaxial with the tube axis, the central opening dimensioned to allow the flag stick to pass freely through while preventing a golf ball from passing therethrough, the carriage having a metal portion;

a transparent cover removably affixed to the carriage, the cover for viewing from the tube top end;

a support member having a first end positioned for supporting the carriage and a second end affixed to the base; and a spring affixed between the support first end and the carriage for biasing the carriage away from the plate, the biasing sufficient for a golf ball dropped into the tube top end to cause the carriage metal portion to make contact with the plate for making a distinctive metal sound.

15. The golf cup as recited in claim 14, further comprising the carriage formed from clear plastic material, the carriage having a metal portion proximate the plate for contacting the plate when the force from the dropped ball causes the carriage to be displaced toward the plate, wherein the contacting creates a distinctive metal ringing sound.

16. The golf cup as recited in claim 14, wherein the rod comprises a sinusoidal shaped elongated rod.

17. The golf cup as recited in claim 14, further comprising:

the carriage having a generally concave circular disk shape, concave upward toward the tube top end, the carriage peripheral portion dimensioned to loosely fit into the tube;

the carriage central opening forming a circular inner edge, the inner edge and peripheral portion substantially forming concentric circles;

a flange member extending downward from the inner edge, the flange member having an edge forming a shelf;

the cover having a generally concave circular disk shape, concave upward toward the tube top end, the cover peripheral portion dimensioned to coaxially fit into the tube;

a peripheral flange member extending downward from the cover peripheral portion, the cover peripheral flange member dimensioned to fit around the carriage peripheral portion, the cover flange member forming a gap at the tube wall;

the cover having a central opening forming a circular inner edge, the inner edge and peripheral portion substantially forming concentric circles;

a cover central flange member extending downward from the inner edge, the cover central flange dimensioned to fit within the carriage central flange member;

a central O-ring located between the cover and carriage central flanges; and a peripheral O-ring located between the carriage peripheral portion and the cover peripheral flange member, the O-rings dimensioned for maintaining a sufficiently dry environment for the advertising element placed between the cover and carriage.

18. The golf cup as recited in claim 17, further comprising the carriage peripheral portion and the carriage flange member having grooves for positioning the O-rings.

19. A method for providing a transparent golf cup portion suitable for displaying removable advertising in combination with delivering a metal pinging sound when a golf ball drops into the cup, the method comprising the steps of:

providing a vertical tube having top and bottom ends, the tube bottom end having a base affixed within the periphery of the tube;

affixing a metal plate to the base;

supporting a non-metallic carriage proximate the plate between the base and tube top end;

sufficiently biasing the carriage away from the plate for supporting holding the carriage out of contact with the plate, the biasing defeated by a force from a golf ball dropped onto the carriage from the tube top end;

affixing a metal extension member to the carriage;

contacting the plate with the metal extension member for causing a metal pinging sound;

placing a transparent cover onto the carriage, the cover positioned to be viewed for the tube top end;

placing an advertising element between the cover and the carriage for viewing the element from the tube top end; and removably sealing the cover to the carriage.

20. The method as recited in claim 19, further comprising the steps of:

placing a frame over the cover, the frame having attachment members for attaching to the cover;

attaching the frame to the cover;

placing a push rod against the carriage;

biasing the push rod against the carriage in opposition to the frame for removing the cover from the carriage;

removing the cover;

replacing the advertising element with a second advertising element, the second advertising element placed thereon for viewing through the cover from the tube top end;

removing the frame from its position attached to the cover; and placing the cover onto the carriage.

21. The method as recited in claim 19, wherein the step of affixing the metal plate to the base further comprises the steps of:

providing an elongated metal rod;

forming the metal rod into a sinusoidal shape;

affixing one end of the rod to the base; and affixing a second end of the rod to the plate for holding the plate away from the base and suspending the plate distant from the tube inside walls.

22. The method as recited in claim 19, wherein the supporting and biasing steps for the carriage further comprise the steps of:

providing a support member having first and second ends;

affixing a spring between the support first end and the carriage; and affixing the second end to the base.

23. The method as recited in claim 19, further comprising the steps of:

forming a hole in the base coaxial with the tube axis for supporting a flag stick;

forming a center aperture in the plate coaxial with the tube axis for loosely receiving the flag stick;

forming the carriage peripheral portion for coaxially fitting within the tube;

forming a gap between the carriage peripheral portion and the tube inside wall;

dimensioning the gap to be substantially smaller than a golf ball diameter for preventing the golf ball from passing through the gap;

placing a central opening in the carriage coaxial with the tube axis for loosely receiving the flag stick and dimensioning the opening for cradling a golf ball; and forming a central aperture in the cover for communicating with the carriage center opening.

24. The method as recited in claim 19, wherein the step of removably sealing the cover to the carriage further comprises the steps of:

forming a circular disk shaped carriage;

dimensioning the carriage peripheral portion to coaxially fit loosely into the tube;

forming a circular opening coaxial with the tube axis;

extending a flange member downward from the edge of the circular opening;

forming a shelf extending toward the tube axis, the shelf dimensioned to receive a push rod used in removing the cover;

forming the cover into a circular disk shape having a peripheral portion dimensioned to fit onto the carriage;

extending a peripheral flange member downward from the cover peripheral portion, the cover peripheral flange dimensioned to communicate with the carriage peripheral portion;

forming a central opening in the cover; and extending a cover central flange member downward from the central opening edge, the cover central flange member dimensioned to communicate with the carriage central flange member;

forming grooves in the carriage peripheral portion and the carriage flange member for receiving O-rings;

placing a central O-ring between the cover and carriage central flange members, the O-ring resting in the flange groove;

placing a peripheral O-ring between the cover peripheral flange member and the carriage peripheral portion, the O-ring resting in the carriage peripheral portion groove;

dimensioning the O-rings for sufficiently providing a seal for keeping the advertising element dry.

* * * * *